US008003290B2

(12) United States Patent
Urabe et al.

(10) Patent No.: US 8,003,290 B2
(45) Date of Patent: Aug. 23, 2011

(54) DEVELOPING AGENT AND METHOD FOR MANUFACTURING THE SAME

(75) Inventors: Takashi Urabe, Sunto-gun (JP); Tsuyoshi Ito, Izunokuni (JP); Motonari Udo, Mishima (JP); Masahiro Ikuta, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1233 days.

(21) Appl. No.: 11/623,600

(22) Filed: Jan. 16, 2007

(65) Prior Publication Data

US 2008/0171276 A1 Jul. 17, 2008

(51) Int. Cl.
*G03G 9/087* (2006.01)

(52) U.S. Cl. ..... 430/137.14; 430/109.4; 430/137.19

(58) Field of Classification Search ..... 430/137.14, 430/109.4
See application file for complete search history.

(56) References Cited

U.S. PATENT DOCUMENTS

| | | | | |
|---|---|---|---|---|
| 7,531,276 | B2 * | 5/2009 | Ishiyama et al. | 430/42.1 |
| 7,560,213 | B2 * | 7/2009 | Matsuoka et al. | 430/109.4 |
| 2003/0124448 | A1 * | 7/2003 | Shinzo et al. | 430/109.4 |
| 2005/0271965 | A1 * | 12/2005 | Kamiyoshi et al. | 430/111.4 |
| 2007/0281240 | A1 | 12/2007 | Urabe et al. | |
| 2008/0090163 | A1 * | 4/2008 | Agur et al. | 430/108.1 |
| 2008/0171282 | A1 | 7/2008 | Urabe et al. | |

FOREIGN PATENT DOCUMENTS

| | | |
|---|---|---|
| JP | 63-282752 | 11/1988 |
| JP | 06-250439 | 9/1994 |
| JP | 09-311502 | 12/1997 |
| JP | 10-301332 | 11/1998 |
| JP | 11-311877 | 11/1999 |
| JP | 2001-154403 | 6/2001 |

* cited by examiner

*Primary Examiner* — Janis L Dote
(74) *Attorney, Agent, or Firm* — Turocy & Watson, LLP

(57) ABSTRACT

A method for manufacturing a developing agent by mixing a resin having a dissociable functional group and an aqueous medium, subjecting the mixture to mechanical shearing, finely pulverizing the pulverized mixture to form resin microparticles, adding a dispersion of colorant particles, causing the resin microparticles and colorant particles to agglomerate, and forming toner particles.

16 Claims, 1 Drawing Sheet

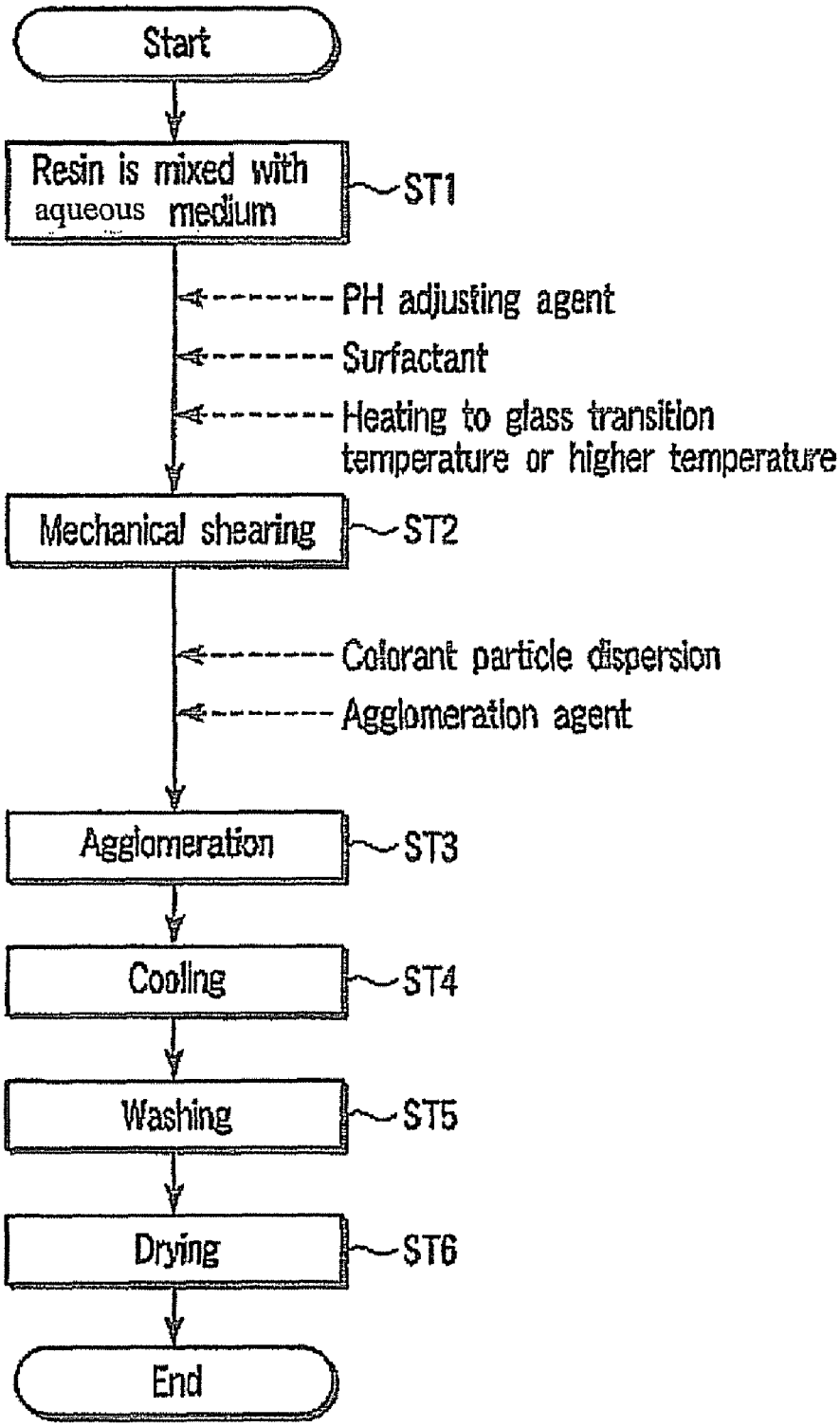
FIGURE

DEVELOPING AGENT AND METHOD FOR MANUFACTURING THE SAME

BACKGROUND OF THE INVENTION

In electrophotography, an electric latent image is formed on an image carrier, the latent image is then developed with a toner, the toner image is transferred onto a transfer material such as paper, and the transferred image is fixed by means of heating, pressing, and the like. The toner used can be not only the conventional monochromatic black toner. Thus, in order to form a full-color image, toners of a plurality of colors are used to form an image.

A toner can be in the form of a two-component developing agent in which the toner is used in a mixture with carrier particles, or in the form of a single-component developing agent using a magnetic toner or a nonmagnetic toner. The toners are usually manufactured by a kneading and grinding method. With the kneading and grinding method, a binder resin, a pigment, a parting agent such as wax, and a charge controlling agent are melt kneaded, cooled, finely ground, and classified to produce the desired toner particles. The toner can be obtained by adding inorganic and/or organic microparticles, according to the object, to the surface of toner particles manufactured by the kneading and grinding method.

In the case of toner particles manufactured by the kneading and grinding method, the shape is difficult to control intentionally. In particular, in the case a material with a high grinding ability is used, fine pulverization easily proceeds and in a two-component developing agent, the finely pulverized toner fixedly adheres to the carrier surface, whereby the charge deterioration of the developing agent is accelerated, whereas in the case of a single-component developing agent, the finely pulverized toner is scattered or developing ability thereof degrades according to changes in the toner shape and the image quality is deteriorated. Further, if grinding occurs at the interface of binder resin and wax, the wax separates from the toner and easily contaminates the developing roller, image support, and carrier, and the reliability of the developing agent decreases.

With the foregoing in view, an emulsion polymerization and agglomeration method was recently suggested in JP-A-63-282752 or JP-A-6-250439 as a method for manufacturing a toner in which the shape and surface composition of toner particles are intentionally controlled.

With the emulsion polymerization and agglomeration method, a resin dispersion is produced by emulsion polymerization, a colorant dispersion is also produced in which a colorant is dispersed in a solvent, the two dispersions are mixed to form agglomerated particles equal in diameter to toner particles, and then toner particles are obtained by heating-induced fusion. With the emulsion polymerization and agglomeration method, the toner shape can be freely controlled from indeterminate to spherical by selecting the heating temperature conditions.

With the emulsion polymerization and agglomeration method, the dispersion comprising at least the resin microparticles and the colorant dispersion can be obtained by agglomeration and fusion under the predetermined conditions. However, the types of resins that can be synthesized in the emulsion polymerization and agglomeration method are limited, and although this method can be advantageously used for the manufacture of styrene-acryl copolymers, it cannot be applied to polyester resins that are known to have good fixing ability.

By contrast, a phase inversion emulsification method in which a pigment dispersion, etc., is added to a solution using an organic solvent and then water is added is known as a method for manufacturing a toner using a polyester resin, but with this method, the organic solvent has to be removed and recovered. A method for manufacturing microparticles by mechanical stirring in an aqueous medium, without using an organic solvent, is suggested in JP-A-9-311502, but with this method a resin in a molten state has to be supplied to a stirring apparatus and is difficult to handle. Furthermore, the level of freedom with respect to shape control is low and the toner shape cannot be freely controlled from indeterminate to spherical.

BRIEF SUMMARY OF THE INVENTION

With the foregoing in view, it is an object of the present invention to provide a developing agent that uses no organic solvent, allows the particle size reduction and shape control, has small spread in surface composition, and also has good fixing ability and transfer ability.

The method for manufacturing a developing agent in accordance with the present invention comprises the steps of:

mixing a resin having a dissociable functional group with an aqueous medium, mechanically shearing the resin having a dissociable functional group in the aqueous medium, finely pulverizing the resin, and forming resin microparticles, and mixing the aqueous dispersion comprising the resin microparticles with a dispersion of colorant particles, causing the resin microparticles and the colorant particles to agglomerate, and forming toner particles.

Further, the developing agent in accordance with the present invention comprises toner particles obtained by mixing a resin having a dissociable functional group as a binder resin and an aqueous medium, subjecting the mixture to mechanical stirring to obtain resin microparticles, adding a dispersion of colorant particles to the resin microparticles, and causing the resin microparticles and colorant particles to agglomerate.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

The single FIGURE is a flowchart illustrating an example of the process for manufacturing the developing agent in accordance with the present invention.

DETAILED DESCRIPTION OF THE INVENTION

A method for manufacturing a developing agent according to the first aspect of the present invention comprises the steps of:

mixing a resin having a dissociable functional group with an aqueous medium;

subjecting the resin having a dissociable functional group to mechanical shearing in the aqueous medium, finely pulverizing the resin, and forming resin microparticles; and mixing the aqueous dispersion comprising the resin microparticles with a dispersion of colorant particles, causing the resin microparticles and the colorant particles to agglomerate, and forming toner particles.

A developing agent according to the second aspect of the present invention comprises toner particles obtained by causing the resin microparticles obtained by subjecting an aqueous dispersion of a resin having a dissociable functional group to mechanical stirring and colorant particles to agglomerate in the aqueous dispersion.

With the method in accordance with the present invention, by mixing a resin having a dissociable functional group as a binder resin material with an aqueous medium and subjecting it to mechanical shearing, the resin having a dissociable functional group can be pulverized while being split into microparticles. Further, by mixing an aqueous dispersion comprising the obtained resin microparticles with a dispersion of colorant particles and causing agglomeration in the aqueous dispersion, a developing agent can be obtained without using an organic solvent, this developing agent allowing for fine pulverization and shape control, having a small spread in surface composition, and demonstrating sufficient fixing ability and transferability.

Further, good images can be formed by using such a developing agent.

The present invention will be described below in greater detail with reference to the appended drawings.

The FIGURE shows a flowchart representing an example of the method for manufacturing toner particles to be used in the developing agent in accordance with the present invention.

As shown in the FIGURE, in the method for manufacturing toner particles, first, a particulate resin having a dissociable functional group is mixed with an aqueous medium (ST1).

At least one species from surfactants and pH adjusting agents can be added at random to the aqueous dispersion.

If a surfactant is added, then the resin particles can be easily dispersed in the aqueous medium due to the action of the surfactant that has been adsorbed by the resin particle surface. Further, by adding a pH adjusting agent, the degree of dissociation of the dissociable functional group located on the surface of the mixed product can be increased or polarity is increased, whereby self-dispersivity is improved.

A resin having dissociation ability can be advantageously used for the resin in the form of particles.

The resin particles used preferably have a volume-average particle size of 0.05 mm to 10 mm.

Then, the aqueous dispersion obtained is subjected to mechanical shearing, the resin having dissociable functional group is finely pulverized, and resin microparticles are formed (ST2).

The mechanical shearing can be performed by heating to a temperature equal to or higher than the glass transition temperature of the binder resin.

In accordance with the present invention, by performing mechanical shearing at a temperature equal to or higher than the glass transition temperature in an aqueous medium, splitting into microparticles and pulverization can be performed, while maintaining flowability of the resin having a dissociable group. As a result, resin microparticles that are more uniform in terms of surface shape and particle diameter than the particles obtained by dry grinding can be obtained.

In accordance with the present invention, the size of the resin microparticles thus obtained can be controlled by adjusting the treatment temperature of mechanical shearing, treatment time, and rotation speed or the like when a stirring device is used.

The resin microparticles used in accordance with the present invention preferably have a volume-average particle size of 0.02 to 1 μm.

Upon completion of mechanical shearing, a liquid colorant dispersion comprising a colorant such as pigment particles is added to the aqueous dispersion of resin microparticles.

Wax can be freely added to the liquid dispersion of colorant particles.

Alternatively, a wax dispersion can be prepared and added to the aqueous dispersion of resin microparticles.

A surfactant can be freely added to the liquid dispersion of colorant particles and wax dispersion.

For example, an anionic surfactant can be used as the surfactant.

At least one species from surfactants and pH adjusting agents can be freely added to the aqueous dispersion.

The resin microparticles and colorant particles located in the aqueous dispersion obtained are caused to agglomerate (ST3).

An agglomeration agent can be added to the aqueous dispersion obtained.

For example, pH adjustment, addition of a surfactant, and addition of a water-soluble metal salt can be used as the agglomeration means.

If necessary, an organic solvent can be used.

Furthermore, the agglomeration can be controlled by heating the aqueous dispersion and adjusting the temperature thereof.

Toner particles are then obtained by cooling the aqueous dispersion to a temperature within a range from 5° C. to glass transition temperature (ST4), washing, for example, by using a filter press (ST5), and drying (ST6).

An additive for adjusting the flowability and charge carrying ability can be added to the surface of toner particles.

Further, the toner particles can be mixed with a carrier and used as a two-component developing agent.

Examples of binder resin for use in accordance with the present invention include styrene-acryl copolymers, polyethylene-vinyl acetate copolymer, polyester resins, acrylic resins, phenolic resins, epoxy resins, allylphthalate resins, polyamide resins, maleic acid resins, etc. These resins may be used individually or in combination of two or more thereof.

The preferred among them are resins having an anionic dissociable group selected from a carboxylic acid, sulfonic acid, and phosphoric acid, or a resin having a cationic dissociable group selected from a primary amine group, secondary amine group, tertiary amine group, and quaternary ammonium salt group.

The binder resin preferably has an acid value of 1 or more.

Carbon black, an organic or inorganic pigments or dyes can be used as the colorant employed in accordance with the present invention. Examples of suitable carbon black include acetylene black, furnace black, thermal black, channel black and Ketjen black. Examples of yellow pigments include C. I. Pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183, 185, and C. I. Vat Yellow 1, 3, 20. These pigments can be used individually or in mixtures thereof. Examples of magenta pigments include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, 238, C. I. Pigment Violet 19, and C. I. Vat Red 1, 2, 10, 13, 15, 23, 29, 35. These pigments can be used individually or in mixtures thereof. Examples of cyan pigments include C. I. Pigment Blue 2, 3, 15, 16, 17, C. I. Vat Blue 6, and C. I. Acid Blue 45. These pigments can be used individually or in mixtures thereof.

At least one from waxes and charge controlling agents can be additionally added to the coarsely pulverized mixture.

Examples of suitable waxes include aliphatic hydrocarbon waxes such as low-molecular polyethylene, low-molecular polypropylene, polyolefin copolymers, polyolefin wax, microcrystalline wax, paraffin wax, and Fischer-Tropsch wax, oxides of aliphatic hydrocarbon waxes such as polyethylene oxide wax, block copolymers thereof, vegetable waxes such as candelilla wax, carnauba wax, Japan wax, jojoba wax, and rice wax, animal waxes such as beeswax, lanolin, and whale tallow, mineral waxes such as ozokerite, ceresin, and petrolactam, waxes comprising fatty acid esters, such as montanic acid ester wax and castor wax, as the main components, and products obtained by partial or complete deoxidation of fatty acid esters, such as deoxidized carnauba wax. Other examples include saturated straight-chain fatty acids such as palmitic acid, stearic acid, montanic acid, and also long-chain alkylcarboxylic acids having a long-chain alkyl group, unsaturated fatty acids such as brasidic acid, eleostearic acid, and parinaric acid, saturated alcohols such as stearic alcohol, eicosyl alcohol, behenyl alcohol, carnaubyl alcohol, ceryl alcohol, melissyl alcohol, and long-chain alkyl alcohols having a long-chain alkyl group, polyhydric alcohols such as sorbitol, fatty acid amides such as linolic acid amide, oleic acid amide, and lauric acid amide, saturated fatty acid bisamides such as methylene bis-stearic acid amide, ethylene bis-stearic acid amide, ethylene bis-lauric acid amide, and hexamethylene bis-stearic acid amide, unsaturated fatty acid amides such as ethylene bis-oleic acid amide, hexamethylene bis-oleic acid amide, N,N'-dioleyladipic acid amide, and N,N'-dioleylsebacic acid amide, aromatic bisamides such as m-xylene bis-stearic acid amide and N,N'-distearylisophthalic acid amide, metal salts of fatty acids (generally referred to as metallic soaps) such as calcium stearate, calcium laurate, zinc stearate, and magnesium stearate, waxes obtained by grafting a vinyl monomer such as styrene or acrylic acid onto an aliphatic hydrocarbon wax, partial ester compounds of aliphatic acids and polyhydric alcohols such as monoglycerides of behenic acid, and methyl ester compounds having a hydroxyl group that are obtained by hydrogenation of vegetable oils and fats.

Furthermore, examples of charge controlling agents used to control the amount of electric charge created by friction include metal-containing azo compounds, wherein the metal element is preferably in the form of complexes or complex salts of iron, cobalt, and chromium, or mixtures thereof. In addition, metal-containing salicylic acid derivative compounds can be also used, wherein the metal element is preferably in the form of a complex or complex salt of zirconium, zinc, chromium, or boron, or mixtures thereof.

Amine compounds are preferred as the pH adjusting agents that can be used in accordance with the present invention. Examples of suitable amines include dimethylamine, trimethylamine, monoethyl amine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane, and N,N-diethyl-1,3-diaminopropane.

Examples of surfactants that can be used in accordance with the present invention include anionic surfactants such as sulfuric acid esters or salts, sulfonic acid salts, phosphoric acid esters, and soaps, cationic surfactants such as amine salts and quaternary amine salt, and non-ionic surfactants such as polyethylene glycols, alkylphenolethylene oxide adducts, and polyhydric alcohols.

No specific limitation is placed on the mechanical shearing device used in accordance with the present invention. Examples of suitable devices include medialess shearing machines such as ULTRA-TURRAX (manufactured by IKA Co., Ltd), TK Autohomomixer (manufactured by Primix Co., Ltd.), TK Pipeline Homomixer (manufactured by Primix Co., Ltd.), TK Fill Mixer (manufactured by Primix Co., Ltd.), Cleamix (manufactured by M Technique Co., Ltd.), Clea SS5 (manufactured by M Technique Co., Ltd.), Cavitron (manufactured by Eurotech Co., Ltd.), Fine Flow Mill (manufactured by Taiheiyo Kiko K.K.), Mircofluidizer (manufactured by Mizuho Kogyo K.K.), Ultimizer (manufactured by Sugino Machine K.K.), Nanomizer (manufactured by Yoshida Kogyosha Co., Ltd.), Genus PY (manufactured by Hakusui Kagaku K.K.), New Generation Homogenizer (manufactured by Miryu K.K.), and media shearing machines such as Viscomill (manufactured by Imex Co., Ltd.), Apex Mill (manufactured by Kotobuki Industries Co., Ltd.), Star Mill (manufactured by Ashizawa Fine Tech Co., Ltd.), DCP Super Flow (manufactured by Nippon Eirich K.K.), MP Mill (manufactured by Inoue, Ltd.), Spike Mill (manufactured by Inoue, Ltd.), Mighty Mill (manufactured by Inoue, Ltd.), and SC mill (manufactured by Mitsui Kozan K.K.).

Among the above-described machines, high-pressure shearing machines or Cleamix using the internal shearing force are preferred because they can easily pulverize viscoelastic resins.

In accordance with the present invention, when resin microparticles and colorant particles are agglomerated, a water-soluble metal salt can be used. Examples of suitable water-soluble metal salts include sodium chloride, calcium chloride, calcium nitrate, barium chloride, magnesium chloride, zinc chloride, magnesium sulfate, aluminum chloride, aluminum sulfate and inorganic metal salt polymers such as poly(aluminum chloride), poly(aluminum hydroxide), and calcium polysulfide.

In accordance with the present invention, when resin microparticles and colorant particles are agglomerated, an organic solvent may be also used. Examples of suitable organic solvents include alcohols such as methanol, ethanol, 1-propanol, 2-propanol, 2-methyl-2-propanol, 2-methoxyethanol, 2-ethoxyethanol, and 2-butoxyethanol, and also acetonitrile and 1,4-dioxane.

Inorganic microparticles may be added and mixed on the surface of toner particles in an amount of 0.01-20 wt. % based on the total weight of toner particles to adjust flowability and charging ability. Examples of suitable inorganic microparticles include silica, titania, alumina, strontium titanate, and tin oxide. The inorganic microparticles can be used individually or in mixtures of two or more thereof.

From the standpoint of environmental safety, it is preferred that inorganic microparticles be used that were surface treated with a hydrophobizing agent.

Furthermore, resin microparticles, for example, PMMA with a particle size of 1 μm or less can be added, in addition to such inorganic oxides, to the toner particle surface in an amount of 0.01-10 wt. % based on the entire weight of toner particles in order to improve cleaning ability.

Examples of mixing apparatuses for inorganic microparticles and the like include HENSCHEL MIXER (manufactured by Mitsui Kozan K.K.), SUPER MIXER (manufactured by Kawata K.K.), RIBOCONE (manufactured by Okawara Seisakusho K.K.), NOUTER MIXER (manufactured by Hosokawa Micron K.K.), TABULIZER (manufactured by Hosokawa Micron K.K.), CYCLOMIX (manufactured by Hosokawa Micron K.K.), SPIRAL PIN MIXER (manufactured by Taiheiyo Kiko K.K.), and LEDIGE MIXER (manufactured by Matsubo K.K.).

In accordance with the present invention, coarse particles may be further classified. Examples of classifying machines that are suitable for classifying include ULTRASONIC (manufactured by Koei Sangyo K.K.), GRYO SIFTER (manufactured by Tokuju Kosakusho Co.), VIBROSONIC SYSTEM (manufactured by Dalton Co., Ltd.), SONICLEAN (manufactured by Shinto Kogyo K.K.), TURBO SCREENER (manufactured by Turbo Kogyo K.K.), MICRO-SIFTER (manufactured by Makino Sangyo K.K.), round vibration classifiers, and the like.

The present invention will be descried below in greater detail based on embodiments thereof.

EMBODIMENTS

A dispersion of colorant particles and a wax dispersion for use in the manufacture of a developing agent were prepared as described below.

(Manufacture of Cyan Pigment Dispersion)

A total of 20 parts by weight of a cyan pigment (manufactured by Dainippon Seika K.K.; copper phthalocyanine) and 1 part by weight of an anionic surfactant (Neoplex G-65, manufactured by Kao Corp.) were mixed with 79 parts by weight of ion-exchange water, and the mixture was treated for 60 min in a homogenizer (ULTRATAX T-50, manufactured by IKA Co., Ltd.,) to obtain a pigment dispersion with a volume-average particle size of 207 nm. The particle size distribution was measured with SALD 7000 manufactured by Shimazu Corp.

(Manufacture of Wax Dispersion)

A total of 20 parts by weight of an ester wax (carnauba wax, manufactured by To a Kasei K.K.) and 1 part by weight of an anionic surfactant (Neoplex G-65, manufactured by Kao Corp.) were mixed with 79 parts by weight of ion-exchange water, and the mixture was treated for 10 min in a homogenizer (manufactured by IKA Co., Ltd.) under heating to obtain a wax dispersion with a volume-average particle size of 152 nm. The particle size distribution was measured with SALD 7000 manufactured by Shimazu Corp.

Embodiment 1

A total of 20 parts by weight of a polyester resin (manufactured by Kao Corp., glass transition temperature 62° C., acid value 20), 4 parts by weight of an anionic surfactant (Neoplex G-65, manufactured by Kao Corp.), 1 part by weight of an amine compound (triethylamine, manufactured by Wako Jun'yaku K.K.), and 75 parts by weight of ion-exchange water were charged into Cleamix (CLM-2.2S, manufactured by M Technique Co., Ltd.), and after the sample temperature has reached 80° C., the rotation speed of the Cleamix was set to 18,000 r.p.m, and stirring was conducted for 30 min.

Upon cooling, the volume-average particle size of the resin microparticles obtained was measured with SALD 7000 (manufactured by Shimazu Corp.). The result was 112 nm. A total of 5 parts by weight of the cyan pigment dispersion and 5 parts by weight of the wax dispersion were mixed with 90 parts by weight of the resin microparticle dispersion thus obtained, an aqueous solution of magnesium sulfate was added, the temperature was gradually raised to 70° C., the resin microparticles and pigment particles were caused to agglomerate until the described volume-average particle size was obtained, and toner particles were obtained.

A total of 1 part by weight of an anionic surfactant (Neoplex G-65, manufactured by Kao Corp.) was added to maintain the volume-average particle size of the toner particles and the toner particles were heated to 90° C. and allowed to stay for 3 h to control the shape.

Upon cooling, the toner particles obtained were washed in a centrifugal separator until the electric conductivity of the washing water reached 50 μS/cm, and then drying was performed in a vacuum drier to a moisture content of 0.3 wt. %.

Upon drying, 2 parts by weight of hydrophobic silica (RX-200; manufactured by Nippon Aerosil K.K.) and 0.5 parts by weight of titanium oxide (STT-30EHJ, manufactured by Titan Kogyo K.K.) were caused to adhere to the surface of the toner particles and the desired electrophotographic toner was obtained.

The volume-average particle size of the electrophotographic toner was measured with a COULTER COUNTER (manufactured by Beckman-Coulter, Inc.). The result was 4.5 μm. The roundness measured with FPIA2100 (manufactured by Sysmex Co., Ltd.) was 0.98. The yield was 98%.

The electrophotographic toner was mixed with a carrier at a predetermined ratio, the mixture was loaded in an e-STUDIO 281c copier manufactured by Toshiba Tech Co., Ltd. and modified for evaluation, the fixing unit temperature was changed intentionally, and the lowest fixing unit temperature at which good image could be obtained was evaluated. The result was 150° C.

The transfer ability was also evaluated, and 99% of the electrophotographic toner developed on a photosensitive body was found to be transferred to the paper.

Embodiment 2

A total of 20 parts by weight of a polyester/styrene acryl hybrid resin (manufactured by Kao Corp., glass transition temperature 63° C., acid value 2), 4 parts by weight of an anionic surfactant (Neoplex G-65, manufactured by Kao Corp.), 0.8 part by weight of an amine compound (triethylamine, manufactured by Wako Jun'yaku K.K.), and 75.2 parts by weight of ion-exchange water were charged into Cleamix (CLM-2.2S, manufactured by M Technique Co., Ltd.), and after the sample temperature has reached 80° C., the rotation speed of the Cleamix was set to 18,000 r.p.m, and stirring was conducted for 30 min.

Upon cooling, the volume-average particle size of the resin microparticles obtained was measured with SALD 7000 (manufactured by Shimazu Corp.). The result was 129 nm.

A total of 5 parts by weight of the cyan pigment dispersion and 5 parts by weight of the wax dispersion were mixed with 90 parts by weight of the resin microparticle dispersion thus obtained, the temperature was gradually raised to 70° C., while adding hydrochloric acid, the resin microparticles and pigment particles were caused to agglomerate until the described volume-average particle size was obtained, and toner particles were obtained.

A total of 1 part by weight of an anionic surfactant (Neoplex G-65, manufactured by Kao Corp.) was added to maintain the volume-average particle size of the toner particles and the toner particles were heated to 90° C. and allowed to stay for 1 h to control the shape. Upon cooling, the toner particles obtained were washed in a centrifugal separator until the electric conductivity of the washing water reached 50 μS/cm.

After washing, drying was performed in a vacuum drier to a moisture content of 0.3 wt. %.

Upon drying, 2 parts by weight of hydrophobic silica (RX-200, manufactured by Nippon Aerosil K.K.) and 0.5 parts by weight of titanium oxide (STT-30EHJ, manufactured by Titan Kogyo K.K.) were caused to adhere to the surface of toner particles and the desired electrophotographic toner was obtained. The volume-average particle size of the electrophotographic toner was measured with a COULTER COUNTER (manufactured by Beckman-Coulter, Inc.). The result was 4.9 μm. The roundness measured with FPIA2100 (manufactured by Sysmex Co., Ltd.) was 0.92. The yield was 98%.

The electrophotographic toner was mixed with a carrier at a predetermined ratio, the mixture was loaded in an e-STUDIO 281c copier manufactured by Toshiba Tech Co., Ltd. and modified for evaluation, the fixing unit temperature was changed intentionally, and the lowest fixing unit temperature at which good image could be obtained was evaluated. The result was 150° C.

The transfer ability was also evaluated, and 91% of the electrophotographic toner developed on a photosensitive body was found to be transferred to the paper.

Embodiments 1 and 2 demonstrate that the present invention makes it possible to control freely the shape of the toner.

Embodiment 3

A total of 20 parts by weight of a polyester resin (manufactured by Kao Corp., glass transition temperature 60° C., acid value 5), 4 parts by weight of an anionic surfactant (Neoplex G-65, manufactured by Kao Corp.), 0.8 part by weight of an amine compound (triethylamine, manufactured by Wako Jun'yaku K.K.), and 75.0 parts by weight of ion-exchange water were charged into Cleamix (CLM-2.2S, manufactured by M Technique Co., Ltd.), and after the sample temperature has reached 80° C., the rotation speed of the Cleamix was set to 8,000 r.p.m, and stirring was conducted for 30 min.

Upon cooling, the volume-average particle size of the resin microparticles obtained was measured with SALD 7000 (manufactured by Shimazu Corp.). The result was 956 nm.

A total of 5 parts by weight of the cyan pigment dispersion and 5 parts by weight of the wax dispersion were mixed with 90 parts by weight of the resin microparticle dispersion thus obtained, 3 parts by weight of a cationic surfactant (Cotamine 24P, manufactured by Kao Corp.) was added to the microparticle dispersion thus obtained, the microparticles were caused to agglomerate until the described volume-average particle size was obtained, and toner particles were obtained. A total of 1 part by weight of an anionic surfactant (Neoplex G-65, manufactured by Kao Corp.) was added to maintain the volume-average particle size of the toner particles, and the toner particles were heated to 90° C. and allowed to stay for 3 h to control the shape.

Upon cooling, the toner particles obtained were washed in a centrifugal separator until the electric conductivity of the washing water reached 50 μS/cm, and then drying was performed in a vacuum drier to a moisture content of 0.3 wt. %.

Upon drying, 2 parts by weight of hydrophobic silica (RX-200, manufactured by Nippon Aerosil K.K.) and 0.5 parts by weight of titanium oxide (STT-30EHJ, manufactured by Titan Kogyo K.K.) were caused to adhere to the surface of toner particles and the desired electrophotographic toner was obtained. The volume-average particle size of the electrophotographic toner was measured with a COULTER COUNTER (manufactured by Beckman-Coulter, Inc.). The result was 4.9 μm. The roundness measured with FPIA2100 (manufactured by Sysmex Co., Ltd.) was 0.95. The yield was 98%.

The electrophotographic toner was mixed with a carrier at a predetermined ratio, the mixture was loaded in an e-STUDIO 281c copier manufactured by Toshiba Tech Co., Ltd. and modified for evaluation, the fixing unit temperature was changed intentionally, and the lowest fixing unit temperature at which good image could be obtained was evaluated. The result was 150° C. The transfer ability was also evaluated, and 95% of the electrophotographic toner developed on a photosensitive body was found to be transferred to the paper.

Embodiment 4

A total of 20 parts by weight of a polyester resin (manufactured by Kao Corp., glass transition temperature 62° C., acid value 20), 4 parts by weight of an anionic surfactant (Neoplex G-65, manufactured by Kao Corp.), 1 part by weight of an amine compound (triethylamine, manufactured by Wako Jun'yaku K.K.), and 75 parts by weight of ion-exchange water were charged into a nanomizer (YSMN-2000AR additionally comprising a heating system; manufactured by Yoshida Kikai Kogyo Co., Ltd.). The heating system temperature was set to 120° C. and the processing was repeated three times at an operation pressure of the nanomizer of 150 MPa.

Upon cooling, the volume-average particle size of the resin microparticles obtained was measured with SALD 7000 (manufactured by Shimazu Corp.). The result was 215 nm.

A total of 5 parts by weight of the cyan pigment dispersion and 5 parts by weight of the wax dispersion were mixed with 90 parts by weight of the resin microparticle dispersion thus obtained, an aqueous solution of magnesium sulfate was added, the temperature was gradually raised to 70° C., the resin microparticles and pigment particles were caused to agglomerate until the described volume-average particle size was obtained, and toner particles were obtained.

A total of 1 part by weight of an anionic surfactant (Neoplex G-65, manufactured by Kao Corp.) was added to maintain the volume-average particle size of the toner particles and the toner particles were heated to 90° C. and allowed to stay for 3 h to control the shape. Upon cooling, the toner particles obtained were washed in a centrifugal separator until the electric conductivity of the washing water reached 50 μS/cm, and then drying was performed in a vacuum drier to a moisture content of 0.3 wt. %.

Upon drying, 2 parts by weight of hydrophobic silica (RX-200, manufactured by Nippon Aerosil K.K.) and 0.5 parts by weight of titanium oxide (STT-30EHJ, manufactured by Titan Kogyo K.K.) were caused to adhere to the surface of toner particles and the desired electrophotographic toner was obtained.

The volume-average particle size of the electrophotographic toner was measured with a COULTER COUNTER (manufactured by Beckman-Coulter, Inc.). The result was 4.7 μm. The roundness measured with FPIA2100 (manufactured by Sysmex Co., Ltd.) was 0.98. The yield was 97%.

The electrophotographic toner was mixed with a carrier at a predetermined ratio, the mixture was loaded in an e-STUDIO•281C copier manufactured by Toshiba Tech Co., Ltd. and modified for evaluation, the fixing unit temperature was changed intentionally, and the lowest fixing unit temperature at which good image could be obtained was evaluated. The result was 150° C. The transfer ability was also evaluated, and 99% of the electrophotographic toner developed on a photosensitive body was found to be transferred to the paper.

COMPARATIVE EXAMPLE 1

A total of 90 parts by weight of a polyester resin (manufactured by Kao Corp., glass transition temperature 62° C., acid value 20), 5 parts by weight of cyan pigment (copper phthalocyanine, manufactured by Dainippon Seika K.K.), and 5 parts by weight of an ester wax (carnauba wax, manufactured by To a Kasei K.K.) were mixed and treated in a twin-shaft kneader set to a temperature of 120° C. to obtain a kneaded product.

The kneaded product was repeatedly ground and classified in an air-flow grinder until a volume-average particle size of 4.5-5.0 μm was obtained. A total of 2 parts by weight of hydrophobic silica (RX-200, manufactured by Nippon Aerosil K.K.) and 0.5 parts by weight of titanium oxide (STT-30EHJ, manufactured by Titan Kogyo K.K.) were caused to adhere to the surface of the ground and classified product thus obtained and the desired electrophotographic toner was obtained.

The volume-average particle size of the electrophotographic toner was measured with a COULTER COUNTER (manufactured by Beckman-Coulter, Inc.). The result was 4.6 μm. The roundness measured with FPIA2100 (manufactured by Sysmex Co., Ltd.) was 0.89. The yield was 13%.

The electrophotographic toner was mixed with a carrier at a predetermined ratio, the mixture was loaded in an e-STUDIO 281c copier manufactured by Toshiba Tech Co., Ltd. and modified for evaluation, the fixing unit temperature was changed intentionally, and the lowest fixing unit temperature at which good image could be obtained was evaluated. The result was 150° C.

The transfer ability was also evaluated, and 85% of the electrophotographic toner developed on a photosensitive body was found to be transferred to the paper.

COMPARATIVE EXAMPLE 2

A total of 30 parts by weight of styrene, 8 parts by weight of butyl acrylate, 2 parts by weight of acrylic acid, 1 part by weight of dodecanethiol, and 0.4 part by weight of an anionic surfactant (Neoplex G-65, manufactured by Kao Corp.) were dispersed in 50 parts by weight of ion-exchange water, and the dispersion was emulsified in a flask and heated in nitrogen atmosphere to a temperature 70° C. in the emulsified state. Once the temperature reached 70° C., a solution of 0.1 part by weight of ammonium persulfate in 8.5 parts by weight of ion-exchange water was added, the reaction was conducted for 5 h under the same conditions, and a resin microparticle dispersion was obtained. The particle size distribution was measured with SALD 7000 manufactured by Shimazu Corp. The result was 0.12 μm.

A total of 90 parts by weight of the resin microparticle dispersion, 5 parts by weight of the pigment dispersion, and 5 parts by weight of wax dispersion were mixed. A total of 1 part by weight of magnesium sulfate was added to the mixture, the temperature was raised to 48° C. at a rate of 1° C./min under stirring, the temperature was held for 2 h, and then the temperature was raised to 70° C. at a rate of 1° C./min to obtain toner particles.

The toner particles obtained were washed in a centrifugal separator until the electric conductivity of the washing water reached 50 μS/cm, and then drying was performed in a vacuum drier to a moisture content of 0.3 wt. %.

Upon drying, 2 parts by weight of hydrophobic silica (RX-200, manufactured by Nippon Aerosil K.K.) and 0.5 parts by weight of titanium oxide (STT-30EHJ, manufactured by Titan Kogyo K.K.) were caused to adhere to the surface of toner particles and the desired electrophotographic toner was obtained.

The volume-average particle size of the electrophotographic toner was measured with a COULTER COUNTER (manufactured by Beckman-Coulter, Inc.). The result was 4.9 μm. The roundness measured with FPIA2100 (manufactured by Sysmex Co., Ltd.) was 0.97. The yield was 97%.

The electrophotographic toner was mixed with a carrier at a predetermined ratio, the mixture was loaded in an e-STUDIO 281c copier manufactured by Toshiba Tech Co., Ltd. and modified for evaluation, the fixing unit temperature was changed intentionally, and the lowest fixing unit temperature at which good image could be obtained was evaluated. The result was 180° C.

The transfer ability was also evaluated, and 97% of the electrophotographic toner developed on a photosensitive body was found to be transferred to the paper.

TABLE 1

| | Volume-average particle size (μm) | Roundness | Yield (%) | Temperature of fixing (° C.) | Transfer efficiency (%) | Total evaluation |
|---|---|---|---|---|---|---|
| Embodiment 1 | 4.5 | 0.98 | 98 | 150 | 99 | ○ |
| Embodiment 2 | 4.9 | 0.92 | 98 | 150 | 91 | ○ |
| Embodiment 3 | 4.9 | 0.95 | 98 | 150 | 95 | ○ |
| Comparative Example 1 | 4.6 | 0.89 | 24 | 150 | 85 | X |
| Comparative Example 2 | 4.9 | 0.97 | 97 | 180 | 97 | Δ |

Because the present invention is suitable for manufacturing small-size toner particles, it can be applied not only to powder systems but also to wet electrophotographic systems operating in a dispersion mode.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for manufacturing a developing agent comprising:

mixing particles of a resin having a dissociable functional group and a pH adjusting agent and an aqueous medium and preparing an aqueous dispersion of the particles of resin having a dissociable functional group;

mechanically shearing the particles of resin having a dissociable functional group in the aqueous medium, finely pulverizing the particles of resin, and forming resin microparticles; and mixing the aqueous dispersion comprising the resin microparticles with a dispersion of colorant particles, and adjusting a pH, causing the resin microparticles and the colorant particles to agglomerate, and forming toner particles.

2. The method for manufacturing a developing agent according to claim 1, wherein the mechanical shearing is performed at a temperature equal to or higher than a glass transition temperature of the resin having a dissociable functional group.

3. The method for manufacturing a developing agent according to claim 1, wherein in mixing the resin having a dissociable functional group with an aqueous medium, a surfactant is added to the aqueous medium.

4. The method for manufacturing a developing agent according to claim 1, wherein the pH adjusting agent is an amine compound.

5. The method for manufacturing a developing agent according to claim 3, wherein the surfactant is an anionic surfactant.

6. The method for manufacturing a developing agent according to claim 1, wherein the resin microparticles have a volume-average particle size of 0.02-1 μm.

7. The method for manufacturing a developing agent according to claim 1, wherein the toner particles comprise at least one from amongst a wax and a charge controlling agent.

8. The method for manufacturing a developing agent according to claim 1, wherein the resin having a dissociable functional group has an acid value of 1 or more.

9. The method for manufacturing a developing agent according to claim 1, wherein in forming the toner particles, the resin microparticles and the colorant particles are caused to agglomerate by using at least one process from amongst adding a surfactant, adding a water-soluble metal salt, adding an organic solvent, and adjusting a temperature.

10. A method for manufacturing a developing agent comprising:

mixing particles of a polyester resin and a pH adjusting agent and an aqueous medium and preparing an aqueous dispersion of particles of a polyester resin having a dissociable functional group;

subjecting the particles of polyester resin to mechanical shearing in the aqueous medium, finely pulverizing the particles of resin, and forming polyester resin microparticles; and mixing the aqueous dispersion comprising the polyester resin microparticles with a dispersion of colorant particles, and adjusting a pH, causing the resin microparticles and the colorant particles to agglomerate, and forming toner particles.

11. The method for manufacturing a developing agent according to claim 10, wherein the mechanical stirring is performed at a temperature equal to or higher than a glass transition temperature of the polyester resin.

12. The method for manufacturing a developing agent according to claim 10, wherein in mixing the polyester resin with an aqueous medium, a surfactant is added to the aqueous medium.

13. The method for manufacturing a developing agent according to claim 10, wherein the pH adjusting agent is an amine compound.

14. The method for manufacturing a developing agent according to claim 12, wherein the surfactant is an anionic surfactant.

15. The method for manufacturing a developing agent according to claim 10, wherein the resin microparticles have a volume-average particle size of 0.02-1 μm.

16. The method for manufacturing a developing agent according to claim 10, wherein in forming the toner particles, the resin microparticles and the colorant particles are caused to agglomerate by using at least one process from amongst adding a surfactant, adding a water-soluble metal salt, adding an organic solvent, and adjusting a temperature.

* * * * *